US009631389B2

(12) United States Patent
Mastio et al.

(10) Patent No.: US 9,631,389 B2
(45) **Date of Patent: *Apr. 25, 2017**

(54) APPARATUS FOR CLEANING AN IMMERSED SURFACE PROVIDED WITH AN ACCELEROMETER DEVICE WHICH DETECTS GRAVITATIONAL ACCELERATION

(71) Applicant: ZODIAC POOL CARE EUROPE, Paris (FR)

(72) Inventors: Emmanuel Mastio, East Lindfield (AU); Thierry Michelon, Toulouse (FR); E. Keith McQueen, Vista, CA (US); Tawny Jean Cothran, Oceanside, CA (US)

(73) Assignee: Zodiac Pool Care Europe, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 14/284,467

(22) Filed: May 22, 2014

(65) Prior Publication Data

US 2014/0291220 A1 Oct. 2, 2014

Related U.S. Application Data

(63) Continuation-in-part of application No. 12/971,269, filed on Dec. 17, 2010, now Pat. No. 8,771,504.
(Continued)

(30) Foreign Application Priority Data

Dec. 22, 2009 (FR) ..... 09 06230

(51) Int. Cl.
*E04H 4/16* (2006.01)

(52) U.S. Cl.
CPC ..... *E04H 4/1654* (2013.01); *E04H 4/16* (2013.01)

(58) Field of Classification Search
CPC ..... E04H 4/1654
(Continued)

(56) References Cited

U.S. PATENT DOCUMENTS 5,435,031 A † 7/1995 Minami
5,569,371 A 10/1996 Perling
(Continued)

FOREIGN PATENT DOCUMENTS

CN 101481957 B 6/2011
EP 1041220 A2 4/2000
(Continued)

OTHER PUBLICATIONS

Office Action dated Oct. 23, 2013 in U.S. Appl. No. 12/971,269.
(Continued)

*Primary Examiner* — Fred Prince
(74) *Attorney, Agent, or Firm* — Kilpatrick Townsend & Stockton LLP; Dean W. Russell

(57) ABSTRACT

The invention relates to an apparatus for cleaning an immersed surface, comprising a hollow body, guiding and driving members, a filtration chamber which is provided in the hollow body and which has at least one liquid inlet, at least one liquid outlet and a hydraulic circuit for circulation of liquid through a filtering device. An accelerometer device is fixedly joined to the hollow body and which is adapted to provide instantaneous measurements of at least one acceleration component of the terrestrial gravity in at least one fixed direction which is fixed relative to the hollow body, and a processing unit for processing the acceleration measurements supplied by the accelerometer device.

9 Claims, 9 Drawing Sheets

Related U.S. Application Data

Figure 1:
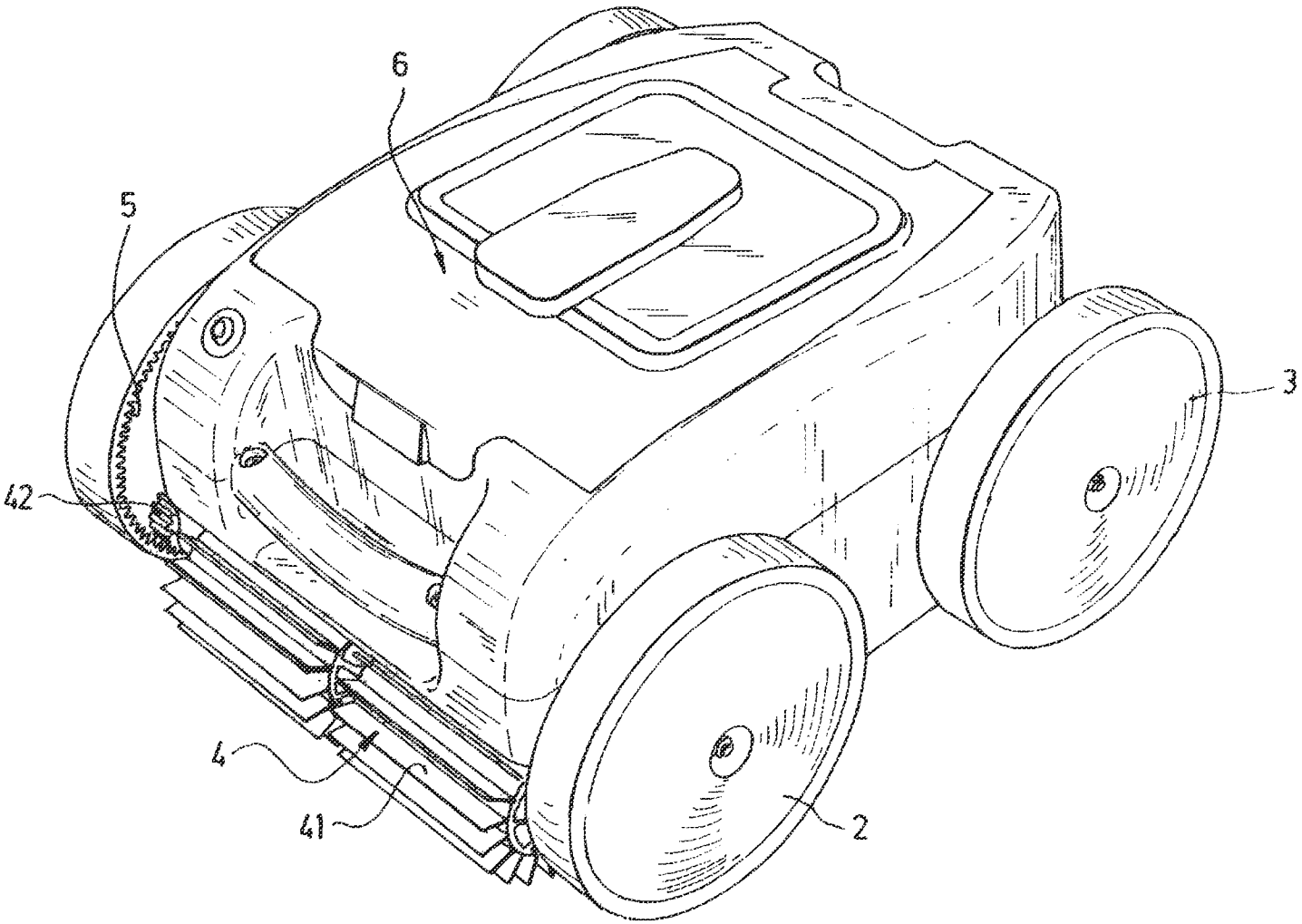

(60) Provisional application No. 61/300,545, filed on Feb. 2, 2010.

(58) Field of Classification Search
USPC ..... 210/167.15, 167.16, 167.17, 143, 144; 134/166 R; 15/1.7
See application file for complete search history.

(56) References Cited

U.S. PATENT DOCUMENTS

| | | | | |
|---|---|---|---|---|
| 6,017,400 | A | 1/2000 | Clark et al. | |
| 7,257,483 | B2 | 8/2007 | Blain et al. | |
| 7,621,014 | B2 † | 11/2009 | Katz | |
| 8,551,254 | B2 | 10/2013 | Dayton et al. | |
| 8,623,201 | B2 | 1/2014 | Hui | |
| 2003/0201218 | A1 | 10/2003 | Henkin et al. | |
| 2004/0021439 | A1 | 2/2004 | Porat et al. | |
| 2005/0171639 | A1 | 8/2005 | Uehigashi et al. | |
| 2006/0010638 | A1 | 1/2006 | Shimizu et al. | |
| 2006/0100820 | A1 | 5/2006 | Davidson | |
| 2007/0094817 | A1 | 5/2007 | Stoltz et al. | |
| 2007/0106462 | A1 * | 5/2007 | Blain | G05D 1/10 701/518 |
| 2007/0272273 | A1 | 11/2007 | Adam | |
| 2008/0077278 | A1 | 3/2008 | Park et al. | |
| 2008/0216869 | A1 | 9/2008 | Dayton et al. | |
| 2008/0250581 | A1 * | 10/2008 | Henkin | E04H 4/1654 15/1.7 |
| 2008/0300821 | A1 | 12/2008 | Frank et al. | |
| 2009/0024353 | A1 | 1/2009 | Lee et al. | |
| 2009/0255069 | A1 | 10/2009 | Hui | |
| 2010/0139017 | A1 * | 6/2010 | Stoltz | E04H 4/1663 15/1.7 |
| 2011/0197932 | A1 | 8/2011 | Mastio et al. | |
| 2014/0068881 | A1 * | 3/2014 | Ben-Dov | E04H 4/1654 15/1.7 |

FOREIGN PATENT DOCUMENTS

| | | |
|---|---|---|
| EP | 1905925 | 4/2008 |
| JP | 09005104 | 1/1997 |
| WO | 199934077 | 9/1999 |
| WO | 2009031136 A2 | 3/2009 |

OTHER PUBLICATIONS

Office Action dated Jun. 5, 2013 in U.S. Appl. No. 12/971,269.
Notice of Allowance dated Feb. 28, 2014 in U.S. Appl. No. 12/971,269.
Search Report dated Jun. 9, 2009 in Application No. FR0906230.
"Applications of Magnetic Sensors for Low Cost Compass Systems" by Michael J. Caruso, Honeywell SSEC Apr. 18, 2002 (8 pages).
Measuring tilt with Low-g Accelerometers, Freescale AN3107 pub. May 2005, (8 pages).
Low Cost ±2g/±10g Dual Axis iMEMS® Accelerometers with Digital Output, Analog Devices, ADXL202/ADXL210, 1999 (11 pages).
Kionix AN 005, Tilt-Sensing with Kionix MEMS Accelerometers, Nov. 30, 2007, (7 pages).
The Robot Builders Bonanza, Gordon McComb, McGraw Hill, 2001, pp. 682-692 (14 pages).
Robot Builders Sourcebook, Gordon McComb, McGraw Hill, 2003, pp. 577-579 (5 pages).
Statutory Declaration of Rod Briggs (3 pages; Jun. 30, 2016).
Statutory Declaration of Rod Briggs (13 pages; Aug. 4, 2016).
Statutory Declaration of Adrian Schruhm (3 pages; Jul. 15, 2016).
Statutory Declaration of Adrian Schruhm (3 pages; Jul. 27, 2016).
Statutory Declaration of Adrian Schruhm (3 pages; Aug. 3, 2016).
Statutory Declaration of Ben Mott (2 pages; Aug. 5, 2016).
Statutory Declaration of Ray Keefe (4 pages; Jul. 13, 2016).
Statutory Declaration of Ray Keefe (15 pages; Jul. 26, 2016).
Statutory Declaration of Ray Keefe (18 pages; Jul. 29, 2016).
Statutory Declaration of Ray Keefe (5 pages; Aug. 3, 2016).
Statutory Declaration of Benny Attar (57 pages; Aug. 4, 2016).
Statutory Declaration of Peter Wallace (10 pages; Jul. 29, 2016).
Statutory Declaration of Derek Bade (27pages; Aug. 3, 2016).

* cited by examiner
† cited by third party

APPARATUS FOR CLEANING AN IMMERSED SURFACE PROVIDED WITH AN ACCELEROMETER DEVICE WHICH DETECTS GRAVITATIONAL ACCELERATION

This application claims priority to and the benefit of (1) French Patent Application No. 09.06230 filed on Dec. 22, 2009, (2) U.S. Provisional Patent Application No. 61/300,545 filed on Feb. 2, 2010, and (3) U.S. patent application Ser. No. 12/971,269 (of which this application is a continuation in part), the entire contents of all three of which applications are incorporated herein by this reference.

The invention relates to an apparatus for cleaning an immersed surface.

An apparatus for cleaning an immersed surface is used for cleaning pools such as swimming pools. A swimming pool must be regularly cleaned in order to have water which is suitable for bathing activities. The frequency for cleaning a swimming pool is dependent on its size, shape, location, for example its proximity to trees which are likely to shed leaves, its use, the climate and the demands of the owner, etc.

The majority of known apparatus generally comprise:

- a hollow body,
- rolling members having contact zones with the immersed surface which define a rolling plane of the hollow body over the immersed surface,
- at least one motor for driving at least one rolling member, called a drive rolling member, in order to form a driving device which is capable, via this/these drive rolling member(s), of moving the hollow body over the immersed surface in at least one direction of advance and in a main direction of advance, called a longitudinal direction,
- a filtration chamber which is provided in the hollow body and which has:
- at least one liquid inlet into the hollow body, located at the base of said hollow body,
- at least one liquid outlet out of the hollow body, located remotely from the base of said hollow body,
- at least one hydraulic circuit for flow of liquid between at least one liquid inlet and at least one liquid outlet through at least one filtering device.

The majority of these known apparatus further comprise predetermined programs which are adapted to control the drive motors of the rolling members in order to define the movement trajectories of the apparatus. In this manner, when such a program is activated, the apparatus is moved over the immersed surface in accordance with predetermined trajectories. These programs may, for example, have access to memory means in which there are recorded data which are representative of the dimensions and the shapes of the swimming pool. Consequently, once this program is activated, the apparatus moves in accordance with predetermined movements taking into account the restrictions in terms of shape and dimensions recorded in the memory means.

There further exist programs which seek to optimize the movements of the apparatus over the immersed surface in order to limit the cleaning time.

With such apparatus, however, it is necessary to be able to detect with a degree of precision the position and/or orientation of the apparatus on the immersed surface. The solutions used until now for this purpose are unsatisfactory in so far as they are either simple in principle but unreliable and imprecise during operation (ball type inclination sensors), or on the other hand are relatively complex and costly and in reality imprecise (inertial system with double time integration).

Consequently, there appears to be a need to be able to provide a detection device which is fitted on-board the apparatus and which at the same time is simple and inexpensive, with a high degree of precision and complete reliability.

An object of the invention is to solve this problem.

An object of the invention is also to provide a cleaning apparatus which is provided with a detection device which allows new functions to be provided, in particular with regard to the various categories of events of movement and/or orientation of the apparatus, and more generally its behavior in terms of movement over the immersed surface, including an apparatus which is driven over the immersed surface without a specific movement program.

An object of the invention is in particular to provide a cleaning apparatus which may be self-propelling, independent in terms of its movements and which is capable of adapting automatically to events which it encounters, owing to detection of its position and/or orientation which is sufficiently precise to allow reliable detection of such an event and the implementation of a modification of its driving command in accordance with this detection.

To this end, the invention therefore relates to an apparatus for cleaning an immersed surface, comprising:

- a hollow body,
- guiding and driving members for guiding and driving the hollow body over the immersed surface,
- a filtration chamber which is provided in the hollow body and which has:
- at least one liquid inlet into the hollow body, located at the base of said hollow body,
- at least one liquid outlet out of the hollow body, located remotely from the base of said hollow body,
- at least one hydraulic circuit for circulation of liquid between at least one liquid inlet and at least one liquid outlet through at least one filtering device, wherein it comprises:

- an accelerometer device which is fixedly joined to the hollow body and which is configured to provide instantaneous acceleration measurements of at least one acceleration component of the terrestrial gravity in at least one fixed direction which is fixed relative to the hollow body,
- a processing unit configured to process said instantaneous acceleration measurements supplied by said accelerometer device and configured to provide data which are representative of the angular orientation of each of said at least one fixed direction relative to the vertical.

The inventors have found that such an apparatus for cleaning an immersed surface has displacement movements which are sufficiently slow, with accelerations which are sufficiently small, most often without any impact or vibrations, so that, against all expectations, simple detection of the orientation of at least one fixed direction of the apparatus relative to the gravitational acceleration, that is to say, relative to the local vertical, is sufficient in practice to determine with a very high degree of reliability the movement behavior of the apparatus over the immersed surface, in particular the occurrence of a specific movement event which requires adaptation or modification of the drive command (for example, a blockage, an inversion, a risk of cable entanglement, contact with a base wall, contact with a vertical wall, movement over an inclined wall, arrival of the apparatus at the water line, an intake of air at the water line, etc. or any other functional anomaly). Furthermore, such detection also allows new functions to be conferred on the apparatus, for example detection of the quality of the coating of the immersed surface from the rate of rotational sliding of the apparatus. Such detection also allows the movements of the apparatus to be controlled in accordance with predetermined trajectories (for example, exploration in a straight line or in a helical line) in a simple and reliable manner, with adaptation to the events encountered if the need arises.

Advantageously and according to the invention, said processing unit is adapted to record over time said data representative of the angular orientation of each of said at least one direction relative to the vertical. In this manner, said processing unit can determine not only the angular position of each fixed direction of the apparatus relative to gravity, but also the variations over time of the orientation of each fixed direction of the apparatus and/or the time periods corresponding to these variations. The inventors have found that this data can advantageously be used to detect the occurrence of various events and are in practice found to be sufficient to be able to reliably control an apparatus according to the invention in a completely independent manner.

In this manner, advantageously and according to the invention, the processing unit comprises an event detection module which is adapted to detect, from said data representative of the angular orientation of each fixed direction relative to the vertical, the occurrence of at least one predetermined event relating to the movement of the apparatus. Such an event is selected, for example, from the following events: climbing an inclined wall; climbing an inclined wall in accordance with an incline which does not correspond to the greatest incline; risk of the cable becoming entangled; detection of the quality of the coating of the immersed surface by measuring a rate of rotational sliding; arrival of the apparatus at the base wall and measurement of the depth of the pool; inversion of the apparatus; abnormal position of the apparatus (for example, on its back); arrival of the apparatus at the water line; arrival of the apparatus in contact with a non-horizontal wall (lateral vertical wall or inclined wall), etc.

In an apparatus according to the invention, said processing unit may be on-board, that is to say, carried by the hollow body, and fixedly joined to the hollow body in terms of movement over the immersed surface. In a variant, said processing unit may instead not be on-board, that is to say, offset at the outer side of the hollow body, and independent of the hollow body, for example outside the pool, in particular integrated in an external control box. In this last variant, said processing unit is adapted to remotely communicate with said accelerometer device, for example via an electrical power supply cable of an on-board electric motor which is fixedly joined to the hollow body, or by means of a wireless connection.

Preferably, advantageously according to said invention the accelerometer device is configured to provide instantaneous measurements of three components of terrestrial gravity acceleration in three fixed directions which are each other orthogonal. In one embodiment, the accelerometer device may be constituted by a simple three-axis accelerometer which is mounted so as to be fixed in position relative to the hollow body of the apparatus.

An apparatus according to the invention may comprise all types of guiding and driving members. Advantageously, an apparatus according to the invention comprises guiding and driving members defining contact zones with the immersed surface which define a contact plane. In particular and advantageously said guiding and driving members are rolling members which define a rolling plane.

The invention can be used for different types of apparatus, in particular of the type with electrical and/or hydraulic and/or suction and/or pressure type driving; and/or with electrical and/or suction and/or pressure type pumping, etc. However, the invention is advantageously used for an electrical self-propelled rolling type apparatus. In this manner, advantageously, an apparatus according to the invention, wherein it is a rolling apparatus comprising at least one electric motor for driving at least one rolling member, called a drive rolling member, in order to form a drive device which is capable, via this/these drive rolling member(s), of moving the hollow body over the immersed surface in at least one direction of advance and in a main direction of advance, called a longitudinal direction.

Advantageously and according to the invention, said processing unit comprises a control module which is adapted to provide control signals for each motor in accordance with a predetermined operating mode in accordance with detection data of at least one predetermined event supplied by the event detection module.

Advantageously, in an apparatus according to the invention, said processing unit therefore acts as an automatic control apparatus which is capable of controlling at least one electric drive motor in accordance with said data which represent the angular orientation of each fixed direction of the apparatus relative to the vertical.

Such a processing unit may be of any known type. It may, for example, comprise a microprocessor which is able to access a memory in which there are stored predetermined rules which define drive commands in accordance with the accelerometer data provided by the accelerometer device and, if necessary, in accordance with at least one operating parameter of at least one motor of the apparatus (for example, the rotation speed of each drive motor). These rules involve, for example, driving the electric drive motors so that the apparatus carries out a half-turn when a vertical wall is detected. These rules may also involve increasing the power of the electric motors when an inclined, non-vertical wall is detected so that the apparatus retains the same movement speed in spite of the inclination of the wall. These rules may also involve stopping the electric motors if the accelerometer data reveal that the apparatus has overturned. These rules may also involve making the apparatus pivot several times about itself if the accelerometer data show that the apparatus has carried out several gyration turns in the same direction so that the integrity of the electrical power supply cable of the motors appears to be compromised or the anchoring effect becomes too great. Generally, these rules may be of any type. Furthermore, additional rules may preferably be programmed by the user so that the cleaning apparatus has its own functions which are specific to his pool.

The invention is also advantageously used for an apparatus which comprises at least one motorized pumping device which is at least partially interposed in a hydraulic circuit and which is adapted to produce a flow of liquid between each liquid inlet and each liquid outlet which are connected by that hydraulic circuit. Advantageously, such an apparatus according to the invention comprises at least one on-board electric pumping motor fitted to the hollow body.

This pumping device preferably comprises an electric pumping motor which comprises a rotating drive shaft which is coupled to an axial pumping propeller interposed in a hydraulic circuit whose axis of rotation is inclined relative to the longitudinal direction.

Preferably, said processing unit is adapted to control said motorized pumping device in accordance with said accelerometer data. This control allows modulation of the liquid flow which travels between the liquid inlet and the liquid outlet. The inventors have found that, in numerous situations, a modulation of the liquid flow traveling between each liquid inlet and each liquid outlet does not impair the cleaning performance levels of the apparatus, whilst this allows a reduction in the general electrical consumption of the apparatus. In this manner, in a large number of situations, an apparatus according to the invention consumes less energy whilst having optimum cleaning performance levels.

Said processing unit of an apparatus according to the invention may also be adapted to control a modulation of the liquid flow in accordance with the accelerometer data supplied by the accelerometer device.

An apparatus according to the invention can therefore be controlled so that the pump generates a liquid flow which is variable in accordance with the status of the apparatus. This status is determined by the measurements provided by the accelerometer device.

The accelerometer device of an apparatus according to the invention allows detection of when the apparatus passes the water line, when the apparatus becomes blocked against a bottom plug of a pool, when the apparatus becomes blocked against a vertical wall, etc.

Consequently, the control of the pumping device by the processing unit, based on the accelerometer data derived from the acceleration measurements provided by an accelerometer device, allows the power of the pump to be reduced or even interrupted when the apparatus encounters particular zones, such as a bottom plug, in order to facilitate travel past these zones.

Advantageously and according to the invention, at least one liquid outlet called a rear outlet is orientated towards the rear so that the liquid current which is discharged via that rear outlet can create, by means of reaction, forces whose resultant, called a hydraulic reaction force, has a non-zero longitudinal component for driving the apparatus forwards.

In a variant or in combination, advantageously and according to the invention, at least one rear outlet is orientated in such a manner that the liquid current which is discharged via that rear outlet can further create a hydraulic reaction force which has a non-zero vertical component of the apparatus in a downward direction.

An apparatus which is provided with such a liquid outlet may have a large number of programs specific to a number of situations commonly encountered during normal operation of a cleaning apparatus in a pool, such as a swimming pool. In particular, when such an apparatus encounters a vertical wall at the end of a trajectory over a horizontal or substantially horizontal wall, the front drive members of the apparatus are pressed against that vertical wall owing to the longitudinal component of the hydraulic reaction force, so that the front of the apparatus rises along the vertical wall. Consequently, the drive members which are associated with the hydraulic flux allow the apparatus to climb along the vertical wall. In such a situation, it is advantageous to ensure that the apparatus does not emerge too far above the water line of the pool in order to prevent it from drawing in air. According to the invention, the power of the pumping device may be modulated, and in particular reduced, which allows the climbing speed to be limited, particularly in the region of the water line. To that end, the measurements provided by the accelerometer device allow it to be established that the apparatus is moving along a vertical wall, then arrives at the water line. Furthermore, an apparatus according to the invention, once it has reached the water line, may be moved towards the bottom of the pool whilst remaining pressed against a wall of the pool with the power of the pump being reduced, which reduces the hydraulic jet at the rear of the apparatus and thereby allows the apparatus to descend again towards the bottom of the pool under the effect of its own weight. The reduction in the power of the pump reduces the energy consumption. The drive rolling members can further be completely stopped in this configuration, which further reduces energy consumption levels.

An apparatus according to the invention also allows control in a particularly effective manner when passing stair nosings, that is to say, related junction edges between a vertical wall and a horizontal wall. In the same manner as for an encounter with a vertical wall, the longitudinal component of the hydraulic jet ensures the positioning of the drive rolling members against the walls in such a manner that the apparatus climbs against the vertical wall. When the drive rolling members are disengaged from the vertical wall and therefore no longer allow the apparatus to be driven, the hydraulic driving provides the power necessary to allow pivoting of the apparatus in the direction for returning the rolling members thereof into contact with the horizontal wall forming the stair nosing. The power of the hydraulic jet that is determined by the modulated power of the pump allows complete control of the pivoting angle and adaptation of the reaction of the apparatus to any type of configuration. In this manner, an apparatus according to the invention can readily overcome the nosings of stairs, limiting energy consumption levels and gently ensuring precise returns into contact, which are not liable to damage the apparatus.

The invention also relates to a rolling apparatus for cleaning an immersed surface, characterized in combination by all or some of the features mentioned above or below.

Figure 2:
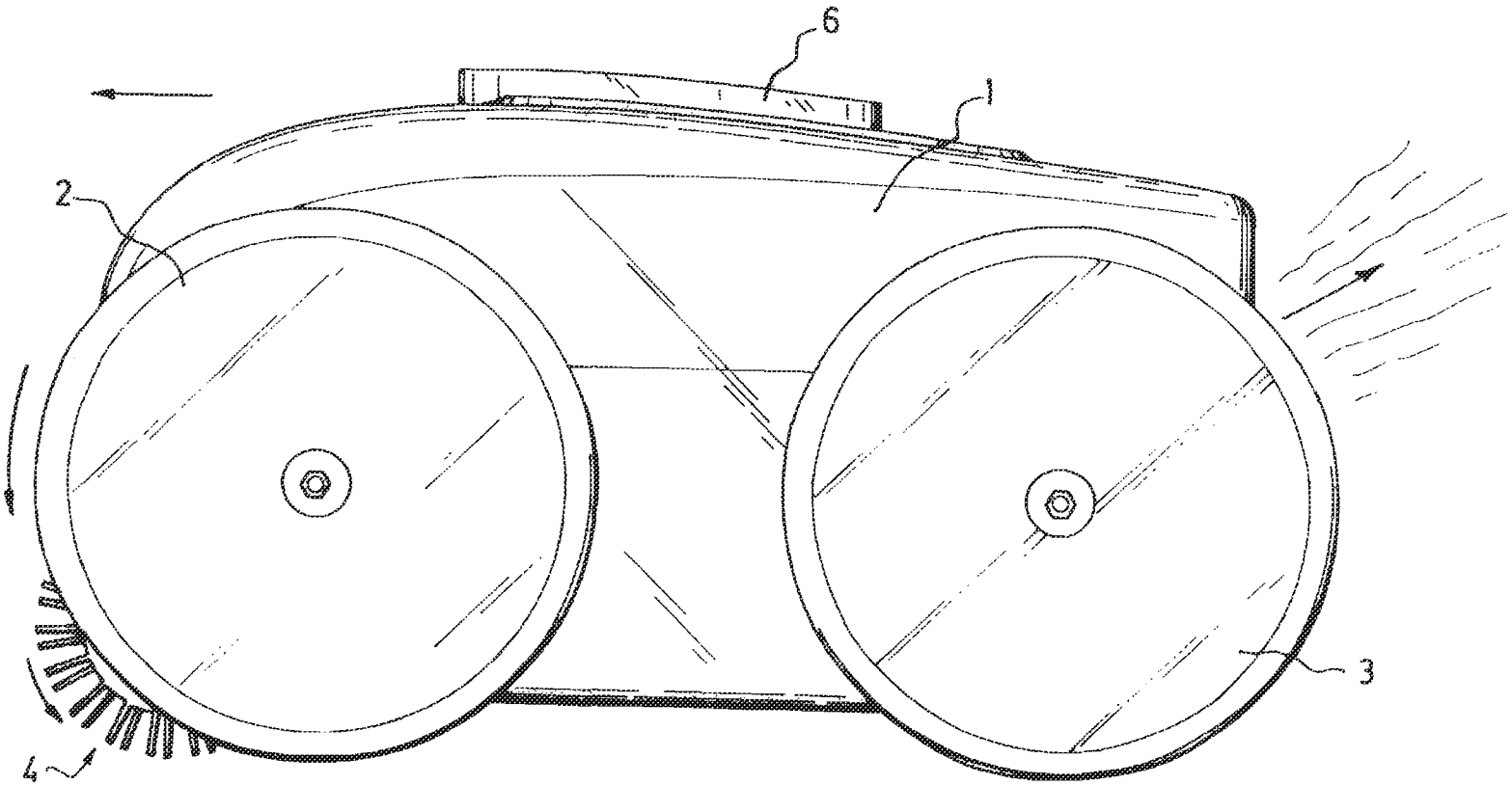
Figure 3:
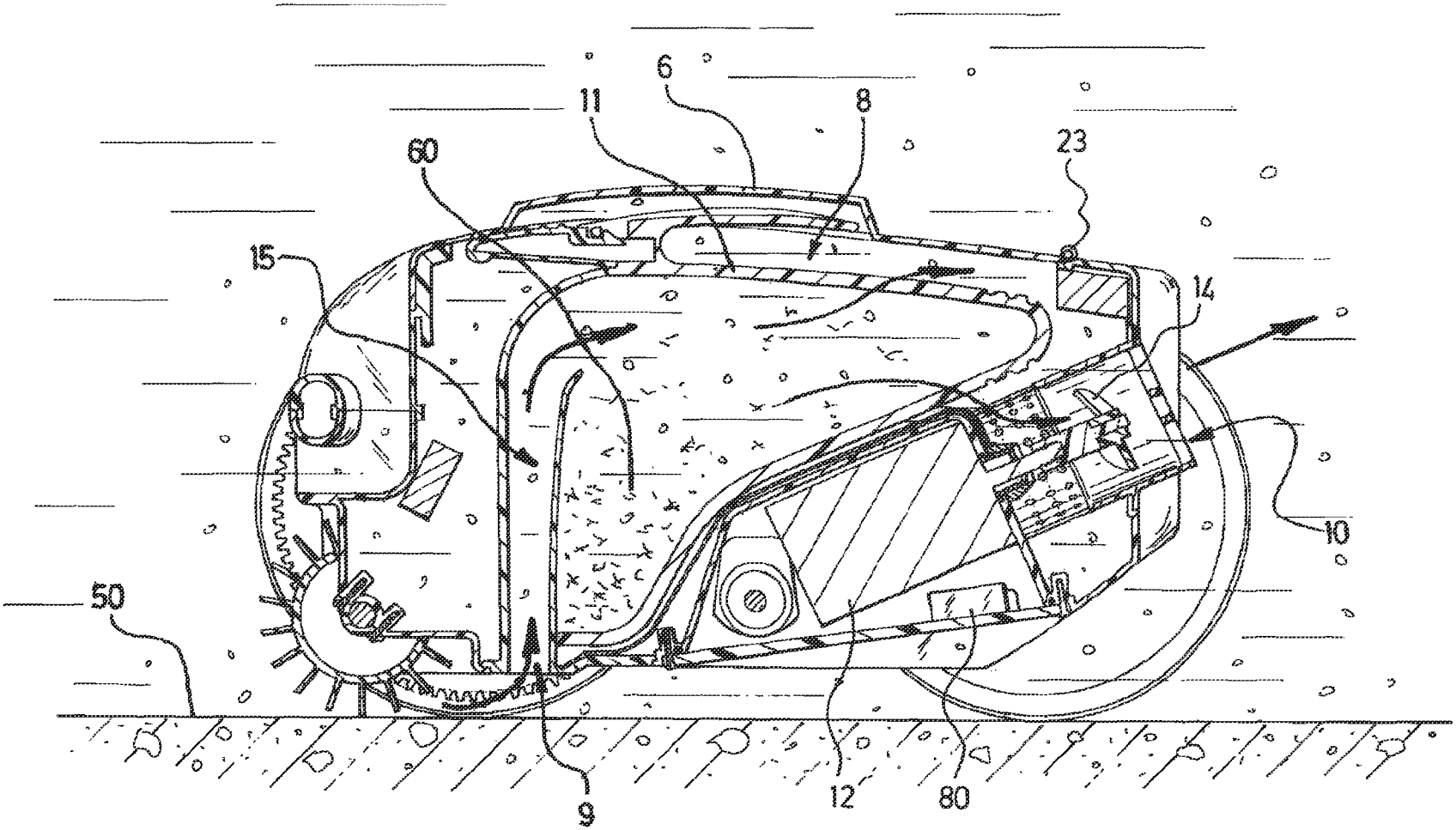
Figure 4:
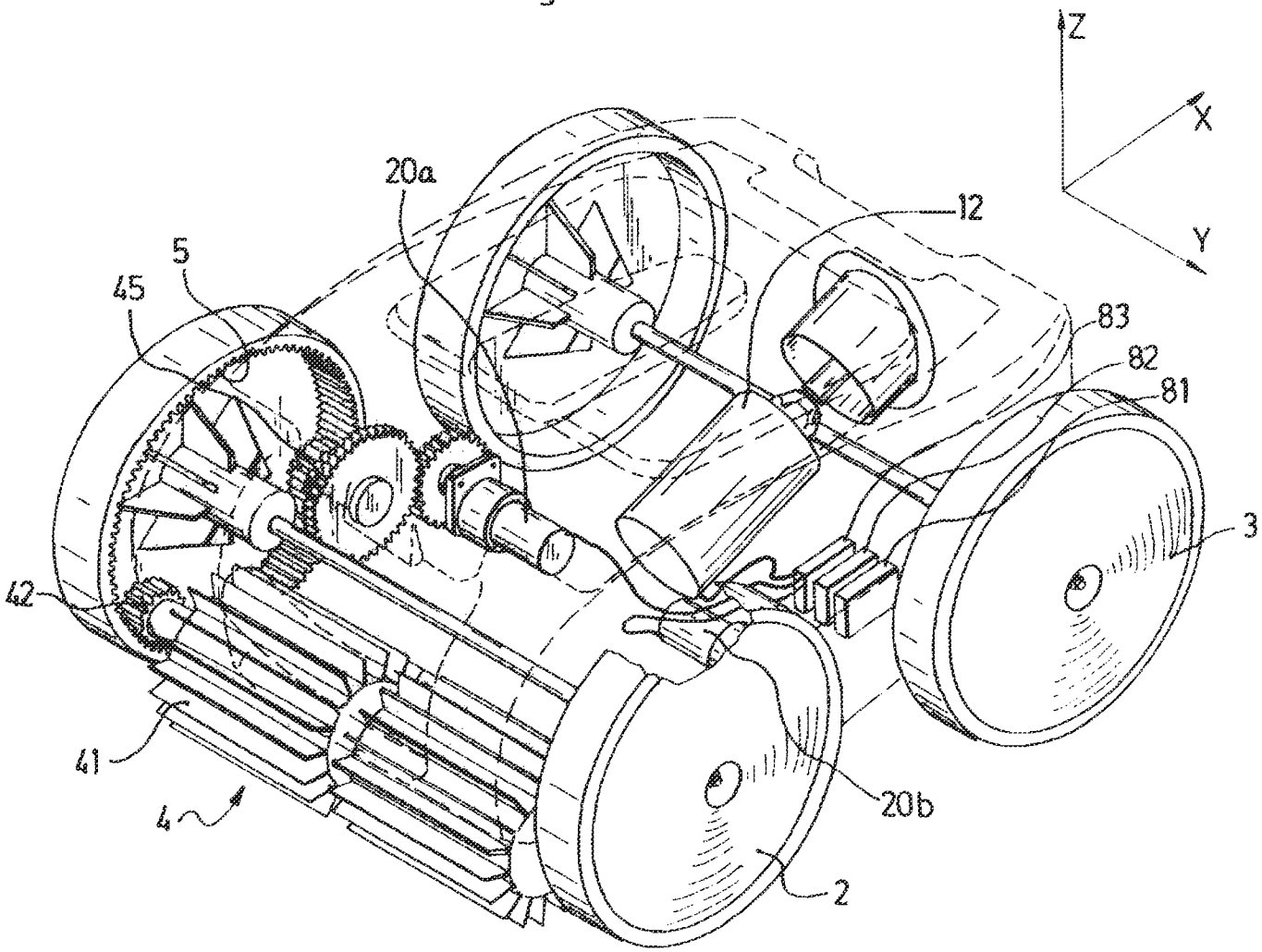
Figure 5:
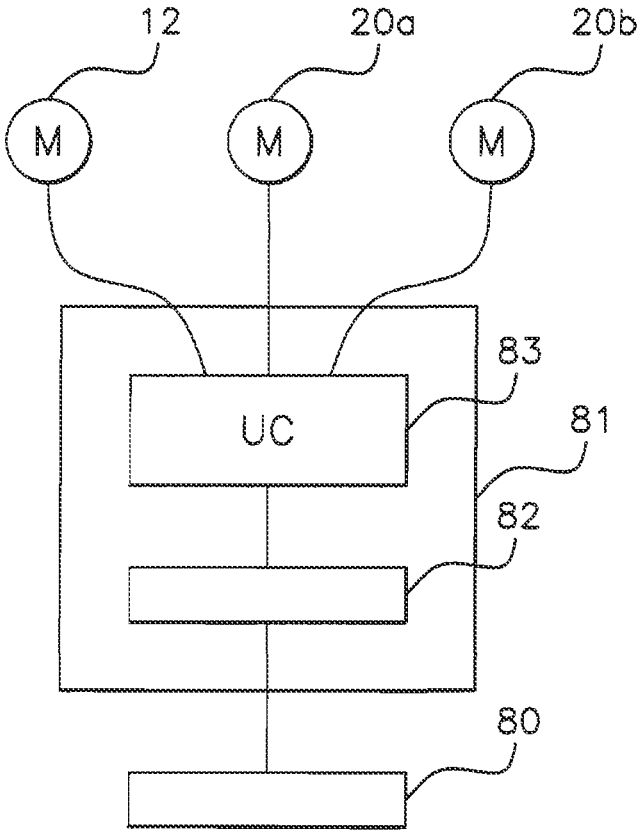
Figure 6:
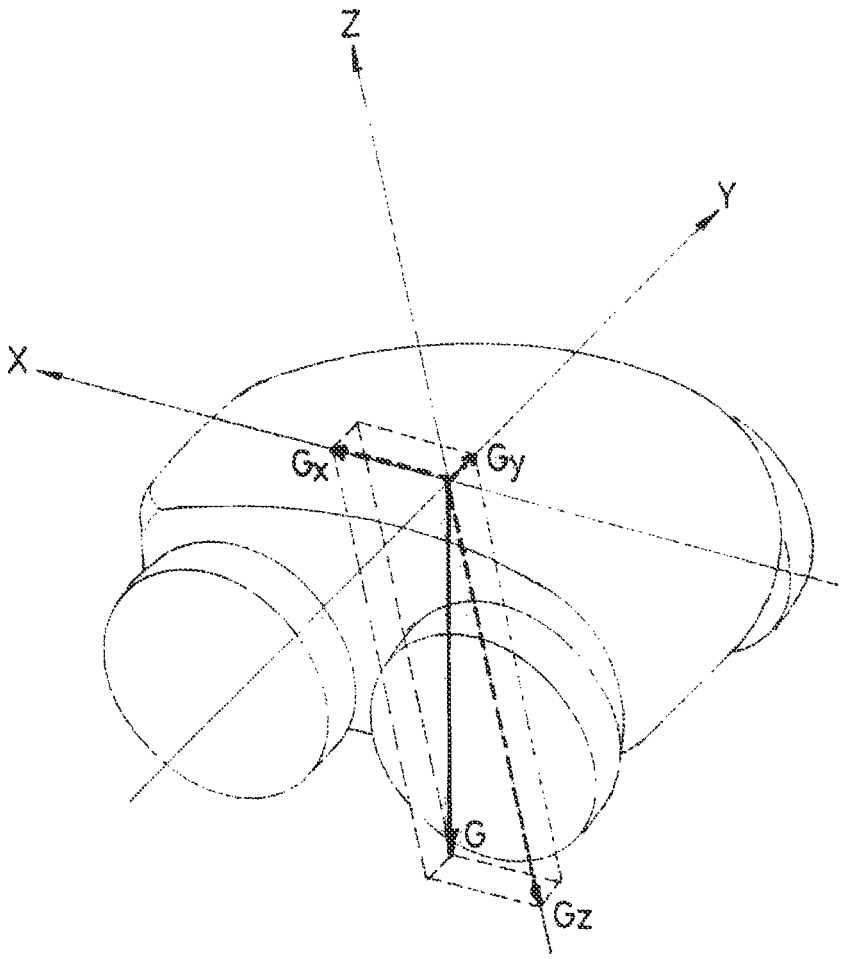
Figure 7:
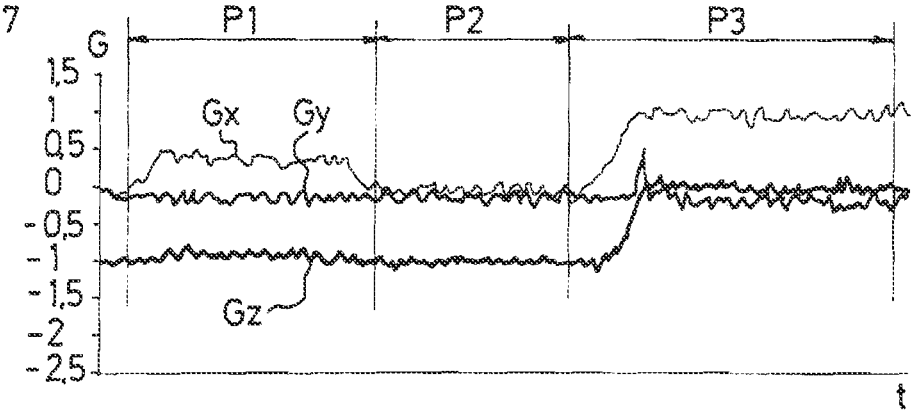
Figure 8:
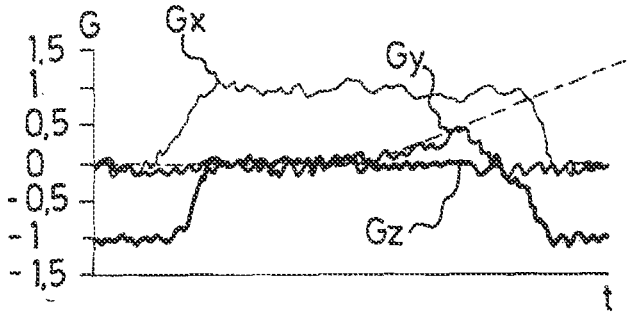
Figure 9:
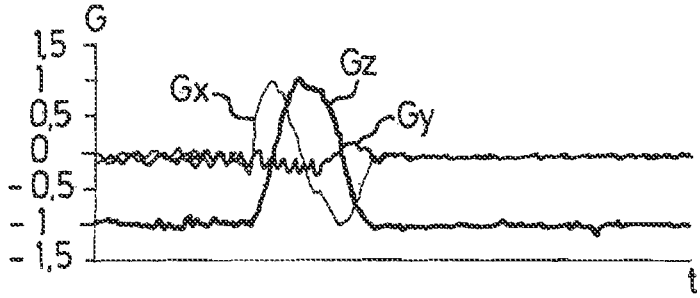
Figure 10:
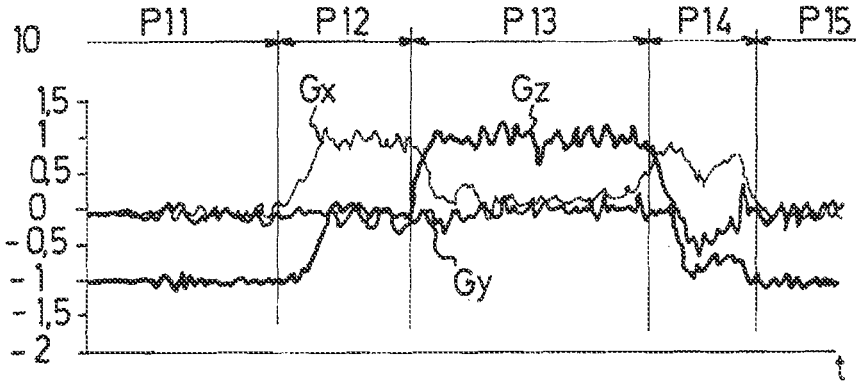
Figure 11:
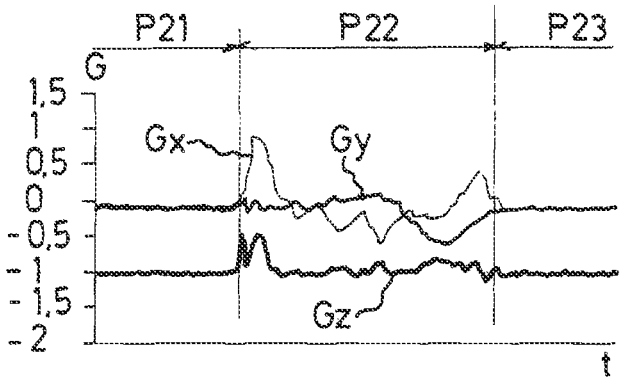
Figure 12:
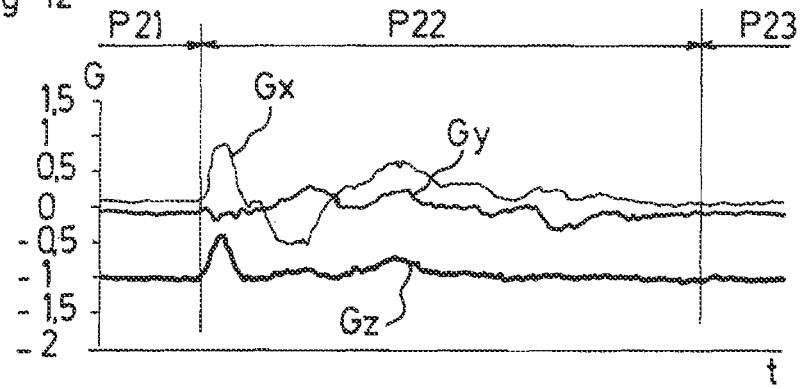
Figure 13:
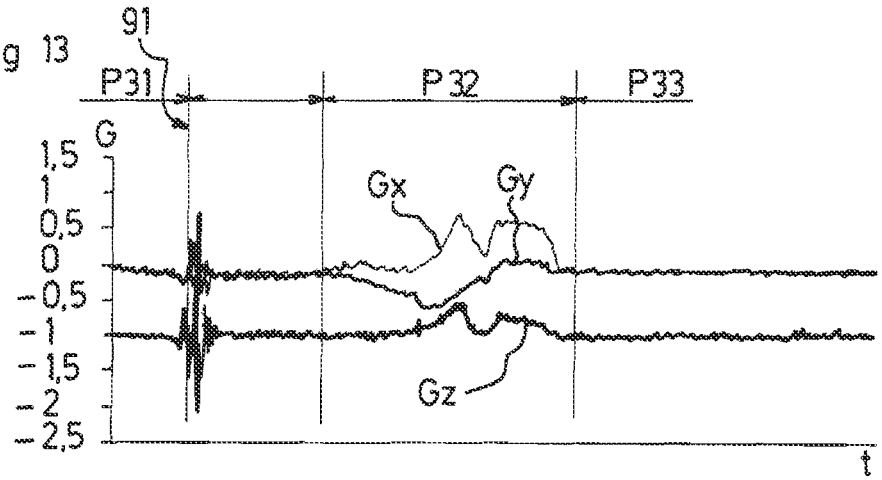

Other objects, features and advantages of the invention will be appreciated from a reading of the following description of an embodiment and examples which are given purely by way of non-limiting example and with reference to the appended Figures, in which:

FIG. 1 is a schematic perspective view of an apparatus for cleaning an immersed surface according to one embodiment of the invention, FIG. 2 is a schematic profile view of the apparatus of FIG. 1, FIG. 3 is a schematic longitudinal section of an apparatus according to one embodiment of the invention, FIG. 4 is a schematic perspective view of the device for driving an apparatus according to one embodiment of the invention, FIG. 5 is a synoptic diagram of the control of the electric drive motors based on the measurements of the components of gravitational acceleration provided by an accelerometer which is fixedly joined to the apparatus according to the invention, FIG. 6 is a schematic view illustrating a reference with three orthogonal axes corresponding to the three measurement axes of the components of gravitational acceleration provided by an accelerometer which is fixedly joined to an apparatus according to the invention illustrated with any orientation for the purposes of illustration, FIG. 7 is a first example of signals provided by the accelerometer of an apparatus according to the invention corresponding to three different successive events, FIG. 8 is a second example of signals provided by the accelerometer of an apparatus according to the invention corresponding to another event, FIG. 9 is a third example of signals provided by the accelerometer of an apparatus according to the invention corresponding to another event, FIG. 10 is a fourth example of signals provided by the accelerometer of an apparatus according to the invention corresponding to another event, FIG. 11 is a fifth example of signals provided by the accelerometer of an apparatus according to the invention corresponding to another event, FIG. 12 is a sixth example of signals provided by the accelerometer of an apparatus according to the invention corresponding to another event, FIG. 13 is a seventh example of signals provided by the accelerometer of an apparatus according to the invention corresponding to another event.

Figure 14:
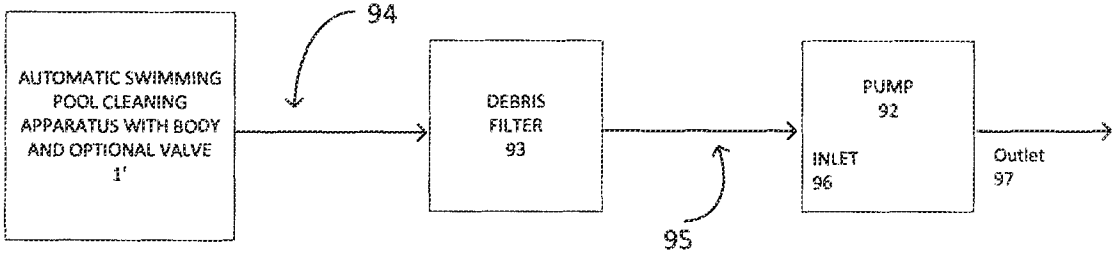

FIG. 14 is a block diagram illustrating water flow, under influence of a pump, from a suction-side hydraulic automatic swimming pool cleaning apparatus to a remote filter not carried by the apparatus.

In the Figures, the scales and the proportions are not strictly complied with for the purposes of illustration and clarity.

In the whole of the following detailed description with reference to the Figures, unless otherwise indicated, each component of the cleaning apparatus is described as it is arranged when the apparatus is moving normally over an immersed horizontal surface in accordance with a preferred direction of advance.

An apparatus according to the illustrated embodiment of the invention comprises a hollow body 1 and rolling members 2, 3, 4 for guiding the hollow body 1 over an immersed surface in at least a preferred direction of advance and in a main direction of advance, which is called a longitudinal direction and which is parallel with the immersed surface.

This hollow body 1 is formed mainly by a concave housing which delimits a main chamber. That concave housing is, for example, constructed by molding or rotational molding. That housing is preferably constructed from a thermoplastic material, such as polyethylene, polypropylene, ABS, PMMA or any equivalent material.

That hollow body 1 has a central chamber which is adapted to receive a filtration chamber. That central chamber is delimited by a lower wall which extends in a substantially horizontal plane; by lateral walls which generally extend in vertical planes; by a front wall which generally extends in a vertical plane, orthogonal relative to the planes of the vertical lateral walls; and by a rear wall which generally extends in a vertical plane orthogonal relative to the planes of the vertical lateral walls.

The lower wall has an opening which extends transversely in the region of the front wall so that liquid can return to the central chamber via this lower transverse opening.

The rear wall comprises a cylindrical opening. In this manner, the cylindrical opening which is provided in the rear wall of the housing is longitudinally offset from the lower transverse opening which is provided in the lower wall. Furthermore, this cylindrical opening is provided in the upper portion of the housing in such a manner that it is also vertically offset from the lower transverse opening.

As illustrated in particular in FIG. 3, this hollow body 1 comprises a filtration chamber 8 which has a liquid inlet 9 located at the base of the hollow body 1, that is to say, in the lower portion of the apparatus, a liquid outlet 10 which is arranged opposite the base of the body 1, that is to say, in the upper portion of the apparatus, and a hydraulic circuit which is adapted to provide a circulation of liquid between the liquid inlet 9 and the liquid outlet 10 through a filtering device 11.

The transverse opening which is provided in the lower wall of the housing forms the liquid inlet 9 of the apparatus and the cylindrical opening which is provided in the rear wall of the apparatus forms the liquid outlet 10 of the apparatus.

The central chamber of the hollow body 1 is adapted to receive the filtering device 11. The filtering device 11 is arranged between the liquid inlet 9 and the liquid outlet 10. This filtering device 11 may be of any known type. For example, the filtering device 11 comprises a rigid frame and a filtering material carried by this rigid frame. Such a filtering device 11 is therefore self-supporting and can be readily handled by a user.

The apparatus also comprises a flap 6 for access to this filtering device 11. This access flap 6 forms an upper wall of the hollow body 1 and covers it. In the embodiment illustrated, this flap 6 is provided on the upper portion of the apparatus so that a person using the apparatus can readily open the flap 6 and remove the filtering device 11. The access flap 6 is articulated to the body 1 of the apparatus by means of hinges 23 which are provided at the rear of the apparatus.

In the preferred embodiment illustrated in the Figures, the rolling members 2, 3, 4 for guiding and driving the apparatus comprise a front axle which comprises front drive wheels 2, one at each side, and a rear axle which comprises rear non-drive wheels 3, one at each side.

Furthermore, preferably and as illustrated in the Figures, the apparatus comprises brushes 4 which are arranged at the front of the apparatus. These brushes 4 are intended to brush the immersed surface and move the pieces of debris which are brushed towards the rear of the apparatus in the direction of the liquid inlet 9 which is provided below the apparatus.

These brushes 4 may be of any type. According to one embodiment of the invention, the apparatus comprises two coaxial front brushes 4. Each brush 4 is adapted to be rotated about an axis which extends in a direction which is called a transverse direction and which is perpendicular relative to the longitudinal direction. Each brush 4 comprises a plurality of fins 41 which extend radially from a brush shaft which forms the rotation axis of the brush 4. The fins 41 are, for example, of rubber or a strong plastics material.

The apparatus further comprises at least one electric motor 20 for driving the front drive wheels 2. Preferably, the apparatus comprises two drive motors 20*a*, 20*b*, one at each side, for independently driving each of the front wheels 2, respectively. To this end, each front wheel 2 has an internal toothed arrangement 5 which co-operates with a pinion 45 which is driven by the corresponding drive motor 20*a*, 20*b*.

The brushes 4 are preferably also rotated by means of at least one electric motor 20*a*, 20*b* for driving the front wheels 2 by means of a gear system. According to this embodiment, the internal toothed arrangement 5 of each front drive wheel 2 co-operates with a pinion 42 which is fixed to one end of the shaft of a brush 4 so that a rotation of the wheel 2, by means of the toothed arrangement 5 and the pinion 42, brings about the rotation of the shaft of the brush 4 and therefore the rotation of the brush 4.

In this manner, in the embodiment illustrated, the rolling members are constituted by the front drive wheels 2, rear non-drive wheels 3 and brushes 4 which are involved in driving and guiding the apparatus over the immersed surface. In any case, the rolling members 2, 3, 4 have zones which are intended to come into contact with the immersed surface and which are coplanar and define a theoretical rolling plane 50. The longitudinal direction of advance of the apparatus is parallel with this theoretical rolling plane 50.

The front wheels 2 preferably have a diameter of between 100 mm and 500 mm, in particular between 150 mm and 250 mm. According to the embodiment of the Figures, the front wheels 2 have a diameter in the order of 200 mm. In this manner, these front wheels 2 facilitate the passing of obstacles and have improved traction. Advantageously, their peripheral tread is formed by or covered with an anti-skid material.

The front wheels 2 and the brushes 4 constitute front drive rolling members 2, 4 which protrude forwards relative to the other constituent elements of the apparatus, in particular the hollow body, in order to form the extreme front portion of the apparatus and first come into contact with an obstacle which is encountered during the forward movement, for example a vertical wall.

According to a preferred embodiment, the apparatus comprises a motorized liquid pumping device which comprises an electric pumping motor 12 which has a rotating drive shaft which is coupled to an axial pumping propeller 14 which is rotated by the motor 12 about an axis. The propeller 14 is interposed in the hydraulic circuit in order to generate therein a flow of liquid between the liquid inlet 9 and the liquid outlet 10.

The liquid outlet 10 is directly opposite the pumping propeller so that the liquid flows out of the liquid outlet 10 in a direction which corresponds to the liquid flow generated by the pumping propeller, this flow having a speed which is orientated in accordance with the rotation axis of the propeller 14. Liquid passes into the hollow body 1 via the liquid inlet 9 arranged below the apparatus. That liquid passes into a liquid intake column 15 in order to reach the filtering device 11. This filtering device 11 allows the liquid to pass via the filtering material and retains the solid debris 60. The filtered liquid reaches the liquid outlet 10 and is discharged at the rear of the apparatus into the pool from which it originates.

An apparatus according to the invention comprises at least one accelerometer 80 which is fixedly joined to the hollow body of the apparatus. This accelerometer 80 is a three-axis accelerometer which is adapted to provide measurements of the components Gx, Gy, Gz of the acceleration of gravity $\vec{G}$ in accordance with three orthogonal axes, a longitudinal axis X, lateral axis Y and height axis Z, which are fixed relative to the accelerometer 80 and therefore relative to the apparatus (FIG. 6). An accelerometer 80 according to the invention may be of any known type, in particular an integrated circuit of the type with analog output or with digital output. The fixing of the accelerometer 80 on the hollow body of the apparatus may be carried out using adhesive means, screw/nut type means, rivets or other equivalent means. That accelerometer 80 is connected to a processing unit 81 configured for processing the measurements provided by that accelerometer.

This processing unit 81 comprises an event detection module 82 and a module 83 for controlling the motors of the apparatus. The event detection module 82 receives the three signals transmitted by the accelerometer 80 corresponding to the instantaneous measurements of the amplitude of the three components Gx, Gy, Gz of the acceleration of gravity $\vec{G}$ along the three orthogonal axes X, Y and Z. These components are representative of the angular orientation of each axis X, Y, Z, respectively, relative to the vertical. The event detection module 82 records these three components Gx, Gy, Gz of the acceleration of gravity $\vec{G}$ over time and analyzes these variations. It carries out tests to determine whether or not these variations correspond to predetermined events.

After a predetermined event has been detected by the event detection module 82, it sends to the control module 83 a signal which identifies this event which has been detected. The control module 83 processes control signals for the various motors of the apparatus, in particular at least the electric drive motors 20*a*, 20*b* and preferably also the electric pumping motor 12.

The processing unit 81 may be of any known type. This processing unit 81 may be fitted on-board the hollow body, as illustrated or alternatively integrated in an external control box of the apparatus, or even be completely independent, outside the pool. When the processing unit is not fitted on-board the hollow body, it is provided with means for remote communication with the accelerometer 80, this also being associated with corresponding communication means which are fitted on-board the hollow body with the accelerometer 80, allowing the measurement signals to be transmitted between the accelerometer 80 and the processing unit. These communication means may be constituted by an electrical power supply cable for an on-board electric motor (drive motor 20 and/or pumping motor 12), or a specific cable which is deployed along such an electrical power supply cable. In a variant, these communication means may also be constituted by wireless connection means, in particular radiofrequency connection means.

According to one embodiment, this processing unit 81 is a digital processing unit. According to another embodiment, the processing unit 81 is an analog processing unit or comprises a combination of digital and analog means. According to a preferred embodiment, the processing unit 81 comprises at least one microprocessor, at least one random access memory which is associated with the microprocessor, at least one mass memory, in particular for recording the accelerometer signals provided by the accelerometer 80 and a clock. Advantageously, in this latter embodiment, the accelerometer 80 is preferably directly welded to the printed circuit which carries the microprocessor. This overcomes the problems of sealing by eliminating any passage of wires through walls between the accelerometer 80 and the microprocessor.

In a variant which is not illustrated, the processing unit 81 comprises a teaching module which is adapted to carry out a teaching operation, under the control of an operator, in order to define events which correspond to time and/or spectral variations of the accelerometer measurements provided by the accelerometer 80.

According to another variant of the invention which is not illustrated, the apparatus further comprises means, called odometric means and which are adapted to estimate the position of the apparatus by means of odometry. These odometric means are adapted to provide measurements, called odometric measurements, from which the movements of the apparatus can be estimated. These odometric measurements are advantageously measurements of the rotation speeds of the wheels of the apparatus during its movements over the immersed surface. These rotation measurements of the wheels are, for example, carried out by means of an optical encoder which is arranged on the axle of the wheels.

These odometric measurements are advantageously transmitted to the processing unit 81 in order to facilitate or accelerate the detection of events by the event detection module 82.

Advantageously, the processing unit 81 also receives signals from sensors associated with the various electric drive motors 20*a*, 20*b* and, if necessary, the electric pumping motor 12. In this manner, the event detection module 82 can also take into account these signals in the context of detecting predetermined events. These signals from the electric motors may be, for example, for each motor, signals representing the rotation speed of the motor and/or signals representing the rotation direction of the motor and/or torque signals produced by a motor and/or signals of the electrical intensity consumed by the motor, etc.

FIGS. 7 to 13 illustrate by way of non-limiting example various possible examples of predetermined events which can be detected by the detection module 82. The ordinate values in these Figures are the ratios of the value of each component to the modulus G of the acceleration of gravity.

In FIG. 7, three successive phases are distinguished corresponding to three successive events.

In the first phase P1, it is found that the lateral component Gy of the gravitational acceleration remains substantially constant and zero, the component Gz of the gravitational acceleration over the height of the apparatus remains substantially constant and negative, and the longitudinal component Gx of the gravitational acceleration remains substantially constant and positive. Such signals correspond to a movement of the apparatus over an inclined surface relative to the horizontal.

Furthermore, in the movement direction of the apparatus relative to the longitudinal axis X, the event detection module 82 can determine whether there is involved a downward movement on the inclined surface or an upward movement on the inclined surface.

If an event is detected which corresponds to an upward movement on an inclined surface, the motor control module 83 can command an acceleration of the electric drive motors 20*a*, 20*b* in order to allow the apparatus to climb the corresponding incline.

If an event is detected which corresponds to a downward movement on an inclined surface, the motor control module 83 can command a slowing of the electric drive motors 20*a*, 20*b* in order to prevent the motors from running away during the descent of the corresponding incline.

In the second phase P2, it is found that the longitudinal component Gx and lateral component Gy of the gravitational acceleration remain substantially constant and zero and the component Gz of the gravitational acceleration along the height of the apparatus remains substantially constant and negative (Gz/G being in the order of −1). Such signals correspond to a movement of the apparatus over a horizontal surface at the bottom of the pool. This is the normal movement of the apparatus, the electric drive motors and pumping motors being driven normally.

In the third phase P3, it is found that the lateral component Gy of the gravitational acceleration remains substantially constant and zero, in the same manner as the component Gz of the gravitational acceleration along the height of the apparatus, and the longitudinal component Gx of the gravitational acceleration remains substantially constant and positive. Such signals correspond to a movement of the apparatus along a vertical wall. Furthermore, in this instance, depending on the movement direction of the apparatus relative to the longitudinal axis X, the event detection module 82 can determine whether there is involved a downward movement on the vertical wall or an upward movement on the substantially vertical wall.

If an event is detected which corresponds to an upward movement on a vertical wall, the motor control module 83 can command an acceleration of the electric drive motors 20*a*, 20*b* in order to allow the apparatus to climb the wall and a modification of the command of the pumping motor 12, in particular in order to prevent excessive movement out of the water when it arrives at the water line. The event detection module 82 monitors the occurrence of an event which corresponds to the arrival of the apparatus at the water line.

If an event is detected which corresponds to a downward movement on a vertical wall, the motor control module 83 can command a slowing of the electric drive motors 20*a*, 20*b* in order to prevent the motors from running away during descent of the vertical wall, and a reduction of the control signal of the pumping motor 12, for example by a predetermined and recorded value. The event detection module 82 monitors the occurrence of an event corresponding to the arrival of the apparatus at the bottom of a wall, that is to say, a return of the apparatus to an orientation which is at least substantially horizontal.

In the example illustrated in FIG. 8, the signals correspond initially to the third phase P3 of FIG. 7 corresponding to the apparatus climbing along a vertical wall. From a specific time, however, it is found that the lateral component Gy of the gravitational acceleration substantially increases, that the longitudinal component Gx of the gravitational acceleration decreases slightly and that the component Gz of the gravitational acceleration along the height of the apparatus remains substantially constant and zero. Such signals correspond to an upward climbing movement of the apparatus on the vertical wall but in accordance with a trajectory which is inclined relative to the vertical. When such an event has been detected by the event detection module 82, the module 83 for controlling the electric drive motors 20*a*, 20*b* commands a slowing of the drive motor opposite the deviation in order to return the apparatus to an ascending vertical trajectory.

In the example illustrated in FIG. 9, the event detection module 82 detects a variation of the longitudinal component Gx and height component Gz in a relatively short space of time, for example in the order of a second, the longitudinal component Gx reaching its maximum value (Gx/G being in the order of 1), then the height component Gz reaching its maximum value (Gz/G being in the order of 1). Such signals correspond to the fact that the apparatus carries out a flip with longitudinal rear inversion.

When such an event is detected, the motor control module 83 interrupts the pumping motor 12 then increments a counter by one unit. If the counter reaches a predetermined threshold value, for example equal to 5, in a predetermined period of time, for example in the order of 15 minutes, this means that this abnormal event (which corresponds to an excessive drive speed of the apparatus) has been repeated. The control module 83 decreases the values of the rotation speed of the electric drive motors 20*a*, 20*b* and the electric pumping motor 12, for example by 10%.

In the example illustrated in FIG. 10, the first two phases P11 and P12 correspond to the second phase P2 of FIG. 7, in which the apparatus moves over a horizontal bottom surface, and to the third phase P3 of FIG. 7 in which the apparatus moves by climbing on a vertical wall, respectively. In the third phase P13, it is found that the component Gz of the gravitational acceleration along the height of the apparatus increases to be positive until it reaches its maximum value (Gz/G being in the order of 1) for a period of time greater than a predetermined threshold, for example of several consecutive seconds, whilst the longitudinal component Gx and lateral component Gy of the gravitational acceleration are substantially constant and zero. Such signals correspond to the apparatus being inverted on its back floating on the surface.

When such an event is detected, the control module 83 imposes a minimum speed or a stoppage on all the electric drive and pumping motors to allow the apparatus to run again and to reposition itself, during its descent owing to its equilibrium, in a normal orientation, which occurs during the fourth phase P14 illustrated in FIG. 10. At the end of this fourth phase P14, the apparatus resumes its normal movement path on the bottom (phase P15), the control module 83 again imposing a normal speed for the different motors. After detecting such an event, advantageously, the motor control module 83 again increments a counter by one unit. If the counter reaches a predetermined threshold value, for example equal to 5, in a predetermined period of time, for example in the order of 15 minutes, this means that this abnormal event has been repeated. The control module 83 decreases the rotation speed values of the electric drive motors 20*a*, 20*b* and the electric pumping motor 12, for example by 10%.

FIGS. 11 to 13 are examples of signals which allow the descent of an apparatus according to the invention to be detected after it has been placed in the water, in accordance with the depth of the pool, and which allow this depth to be estimated.

In FIG. 11, the first phase P21 corresponds to the apparatus being placed in the water in an initial horizontal position so as to be stable on the surface. It is found that the lateral component Gy and the longitudinal component Gx of the gravitational acceleration remain substantially constant and zero, and the component Gz of the gravitational acceleration along the height of the apparatus remains substantially constant and negative with a value which corresponds to its maximum amplitude (in the order of −1). During the second phase P22, there is found a variation of the longitudinal component Gx of the gravitational acceleration which substantially increases up to its maximum value (Gx/G being in the order of 1), and a variation of the height component Gz which also increases up to a mean value (Gz/G in the order of 0.5). When these two conditions are detected, the event detection module 82 starts a clock and stops this clock when all the components of the gravitational acceleration become stable again for a predetermined length of time, for example in the order of two consecutive seconds, corresponding to the third phase P23 during which the apparatus moves normally at the bottom of the pool over a horizontal surface. The duration of the second phase P22 that has passed, between the clock being started and stopped, is an estimation of the depth of the pool.

It should be noted that, if the two above-mentioned conditions are not detected, this means that the apparatus is already at the bottom of the pool, so that the motor control module 83 can initiate the normal cleaning operation of the apparatus.

FIG. 12 is similar to FIG. 11 and illustrates an example in which the duration of the second phase P22 is greater, corresponding to a greater depth of the pool.

FIG. 13 illustrates the example in which the apparatus is thrown carelessly into the pool, which corresponds to the occurrence in the first phase P31 of a violent impact 91 (variation of three rapid and simultaneous components), from which the event detection module 82 initiates the clock. The second phase P32 corresponds again to the descent of the apparatus into the pool and the third phase P33 corresponds to the movement of the apparatus over the horizontal bottom of the pool, as in the example of FIG. 11. The period of time that elapses between the impact 91 and the detection of the end of the descent, carried out as above, also gives an estimation of the depth of the pool in this instance.

The estimation of the depth of the pool also allows the behavior of the apparatus to be adapted in accordance with this depth, and in particular allows cleaning times to be selected and adjusted in accordance with predetermined programs adapted to each depth.

Naturally, the invention may have a very large number of production variants. In particular, other types of event can be detected and a very large number of different scenarios can be envisaged for the control of the motors by the control module 83 in accordance with each event detected. The invention is also used for apparatus other than the one illustrated in the Figures and described above. There is also nothing to prevent the three-axis accelerometer from being replaced with a plurality of accelerometers, for example each one dedicated to a single axis. Furthermore, an apparatus which is provided with a single accelerometer measuring the gravitational component along a single axis may also have advantageous applications in the most simple cases.

FIG. 14 is a block diagram showing water flow from an apparatus 1' functioning within a swimming pool and under influence of pump 92. Also illustrated in FIG. 14 is debris filter 93 positioned remote from a body of apparatus 1'. Hence, apparatus 1' differs from apparatus 1 at least in that debris filter 93 is not carried by the body of apparatus 1'. Otherwise, apparatus 1' many include some, none, or all of the components of apparatus 1 (including, for example, accelerometer 80).

Debris filter 93 may be a skimmer basket or any other object suitable for filtering at least some solid debris from water. As depicted in FIG. 14, when pump 92 is operating, debris-laden water of a swimming pool may be drawn through apparatus 1' and conveyed via conduit 94, such as a hose or pipe, through debris filter 93. After passing through debris filter 93, the water may travel via conduit 95 to inlet 96 of pump 92 and thence through pump 92 to its outlet 97 for subsequent return to the swimming pool.

Preferably, apparatus 1' is a suction-side hydraulic automatic swimming pool cleaner (APC) in which operation of a remote pump 92, together with an optional valve positioned, when present, at least partially within a body of the apparatus 1', serve to draw debris-laden water into and through the body. Non-limiting examples of such suction-side hydraulic APCs are described in U.S. Pat. No. 4,642,833 to Stoltz, et al. and U.S. Pat. No. 4,742,593 to Kallenbach and in U.S. patent application Ser. No. 14/254,111 of van der Meijden, et al., the entire contents of all of which patents and application are incorporated herein by this reference. Unlike most electric and pressure-side hydraulic cleaners, which include filters carried by the bodies of the cleaners (consistent with apparatus 1), most suction-side hydraulic APCs pass debris-laden water through their bodies to remote filters associated with the pools in which they are operating. Alternatively, apparatus 1' (or apparatus 1) may carry a debris filter and, specifically, be a pressure-side hydraulic APC. Non-limiting examples of such pressure-side hydraulic APCs are described in U.S. Pat. No. 4,589,986 to Greskovics, et al. and U.S. Pat. No. 6,665,900 to Wichmann, et al., the entire contents of both of which patents are incorporated herein by this reference.

Apparatus 1 or 1' also may include a gyroscope or other sensors, in some cases incorporating the gyroscope (or other sensors) and accelerometer 80 together on or as part of an integrated circuit (IC). Output of the IC may reflect data solely from accelerometer 80, solely from the gyroscope (or other sensors), or jointly from both (or all). The output may be utilized for any of the purposes previously described herein as well as, for example, to change operational speed or another characteristic of any remote pump 92.

The invention claimed is:

1. An automatic swimming pool cleaning apparatus comprising:

a. a body (i) configured in use to be submerged by water contained within a swimming pool and to move therein and (ii) defining a water inlet;

b. means for drawing pool water into the water inlet of the body in use for passage to a debris filter remote from the body; and c. an accelerometer (i) carried by the body and (ii) configured in use to measure a characteristic of position of the body within the swimming pool.

2. An automatic swimming pool cleaning apparatus according to claim 1 in which the accelerometer is fixed to the body.

3. An automatic swimming pool cleaning apparatus according to claim 1 in which the accelerometer is configured in use to measure a characteristic of position of the body within the swimming pool requiring adaptation or modification of the movement of the body.

4. An automatic swimming pool cleaning apparatus according to claim 1 further comprising means, cooperating with the accelerometer, for measuring the characteristic of position of the body within the swimming pool.

5. An automatic swimming pool cleaning apparatus according to claim 4 in which the means that cooperates with the accelerometer comprises a processing unit.

6. An automatic swimming pool cleaning apparatus according to claim 1 in which the means for drawing pool water into the water inlet of the body in use comprises a valve positioned at least partially within the body.

7. An automatic swimming pool cleaning apparatus according to claim 6 in which the means for drawing pool water into the water inlet of the body in use further comprises a pump remote from the body.

8. An automatic swimming pool cleaning apparatus according to claim 1 in which the means for drawing pool water into the water inlet of the body in use comprises a pump remote from the body.

9. A pressure-side hydraulic automatic swimming pool cleaning apparatus comprising:

a. a body (i) configured in use to be submerged by water contained within a swimming pool and to move therein and (ii) defining a water inlet;

b. a debris filter carried by the body;

c. means for drawing pool water into the water inlet of the body in use for passage into the debris filter; and d. an accelerometer (i) carried by the body and (ii) configured in use to measure a characteristic of position of the body within the swimming pool.

* * * * *